US006004159A

United States Patent [19]

Liang

[11] Patent Number: 6,004,159

[45] Date of Patent: Dec. 21, 1999

[54] FUSE BOX AND FUSE HOLDER ARRANGEMENT

[76] Inventor: Shih-Tsung Liang, No. 10, Lane 31, Ta-Feng St., Lu-Chu Hsiang, Taoyuan County, Taiwan

[21] Appl. No.: 09/136,914

[22] Filed: Aug. 20, 1998

[51] Int. Cl.[6] ..... H01R 13/68

[52] U.S. Cl. ..... 439/621; 439/801

[58] Field of Search ..... 439/621, 622, 439/830–833, 801

[56] References Cited

U.S. PATENT DOCUMENTS

| | | | |
|---|---|---|---|
| 4,950,195 | 8/1990 | Perreault et al. | 439/830 |
| 5,328,392 | 7/1994 | Lin et al. | 439/621 |
| 5,551,894 | 9/1996 | Lin et al. | 439/621 |

*Primary Examiner*—Gary F. Paumen
*Attorney, Agent, or Firm*—Rosenberg, Klein & Bilker

[57] ABSTRACT

A fuse box and fuse holder assembly includes a fuse box, at least one pair of fuse holders mounted inside the fuse box for holding fuse means, the fuse box including a bottom shell and a top cover shell covered on the bottom shell, the bottom shell having at least one pair of shields which receive the at least one pair of fuse holders respectively, a plurality of bottom through holes respectively disposed inside the shields, a plurality of screws respectively mounted in the bottom through holes to secure the fuse holders inside the shields, pairs of locating plates respectively extended from the shields at two opposite sides for supporting the fuse holders in place, and a plurality of retaining holes symmetrically disposed at two opposite sides thereof, the top cover shell having a plurality of downwardly extended hooks respectively hooked in the retaining holes at the bottom shell, the shields each having a tool hole corresponding to the wire clamp of the respective fuse holder, the fuse holders each having a fuse clamp at one end for holding a part of a fuse means, a wire clamp at an opposite end for holding conductors of an electric wire, and a connecting strip connected between the fuse clamp and the wire clamp.

5 Claims, 6 Drawing Sheets

FUSE BOX AND FUSE HOLDER ARRANGEMENT

BACKGROUND OF THE INVENTION

The present invention relates to a fuse box and fuse holder arrangement, and more particularly to such a fuse box and fuse holder arrangement which can be quickly installed to hold the electric wire and the fuse firmly in an electrically connected position.

FIG. 9 shows a fuse mounting arrangement according to the prior art. According to this arrangement, pairs of metal blocks 7 are mounted on a shell to hold a respective electric wire 8, and two fuse clamps 71 are mounted on the shell and respectively connected to the metal blocks 7 to hold the blades of a plug type fuse 5. The metal blocks 7 each have a horizontal wire hole 72, which receives the conductors 81 of one electric wire 8, a vertical screw hole 73 perpendicularly extended from the horizontal wire hole 72, and a screw rod 74 threaded into the vertical screw hole 73 to hold down the conductors 81 of the corresponding electric wire 8. The metal blocks 7 and the fuse clamps 71 are made of different metal materials, and welded together. A high impedance tends to be produced at the connection between the metal blocks 7 and the fuse clamps 71. Furthermore, the conductors 81 of the electric wires 8 may be damaged by the screw rods 74 when the screw rods 74 are fastened tight. FIG. 10 shows another fuse mounting arrangement according to the prior art. According to this arrangement, pairs of fuse clamps 9 are mounted on a flat plate 94, and a cartridge fuse 95 is installed in each pair of fuse clamps 9. Each fuse clamp 9 comprises two clamping arms 91 clamped on one end of the corresponding cartridge fuse 95, an extension strip 92, and a wire hole 921 at the end of the extension strip 92. When the conductors 961 of an electric wire 96 are inserted through the wire hole 921 at the end of the extension strip 92, the conductors 961 are fixedly fastened to the extension strip 92 by tin soldering. Because the conductors 961 of the electric wires 96 are respectively fastened to the extension strips 92 of the fuse clamps 9 by tin soldering, the installation procedure of this arrangement is complicated.

SUMMARY OF THE INVENTION

It is one object of the present invention to provide a fuse box and fuse holder arrangement which can be conveniently installed without welding. It is another object of the present invention to provide a fuse box and fuse holder arrangement which is inexpensive to manufacture. According to one aspect of the present invention, the fuse box and fuse holder assembly comprises a fuse box, at least one pair of fuse holders mounted inside the fuse box for holding fuse means, the fuse box comprising a bottom shell and a top cover shell covered on the bottom shell, the bottom shell having at least one pair of shields which receive the at least one pair of fuse holders respectively, a plurality of bottom through holes respectively disposed inside the shields, a plurality of screws respectively mounted in the bottom through holes to secure the fuse holders inside the shields, pairs of locating plates respectively extended from the shields at two opposite sides for supporting the fuse holders in place, and a plurality of retaining holes symmetrically disposed at two opposite sides thereof, the top cover shell having a plurality of downwardly extended hooks respectively hooked in the retaining holes at the bottom shell, the shields each having a tool hole corresponding to the wire clamp of the respective fuse holder, the fuse holders each having a fuse clamp at one end for holding a part of a fuse means, a wire clamp at an opposite end for holding conductors of an electric wire, and a connecting strip connected between the fuse clamp and the wire clamp. According to another aspect of the present invention, each fuse holder is made from a metal plate by stamping.

DETAILED DESCRIPTION OF THE PREFERRED EMBODIMENT

Figure 1:
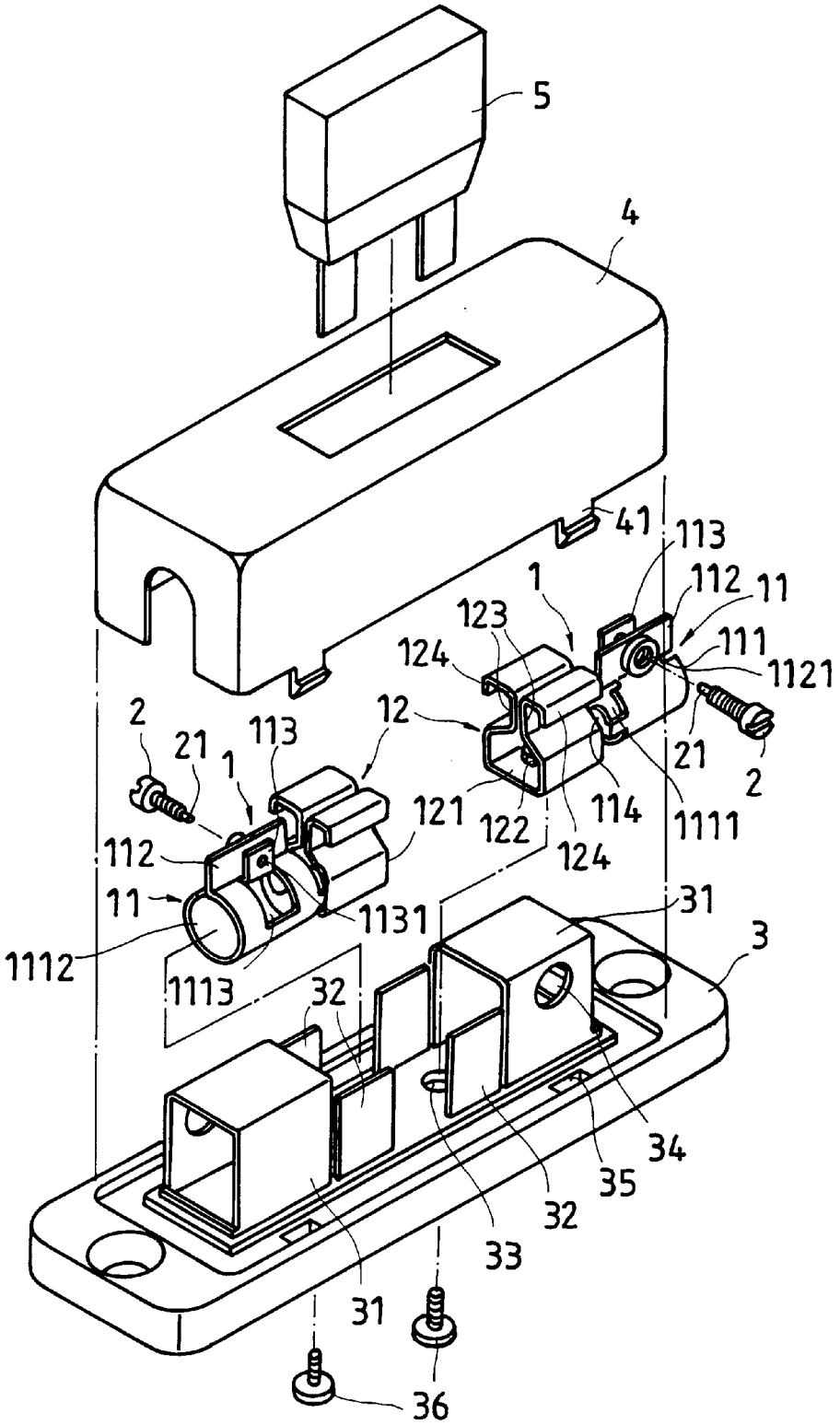
FIG. 1 is an exploded view of the first embodiment of the present invention

Referring to FIGS. from 1 through 4, a fuse holder 1 is made of a metal sheet by stamping, comprising a fuse clamp 12 at one end, a wire clamp 11 at an opposite end, and a connecting strip 13 connected between the fuse clamp 12 and the wire clamp 11.

The fuse clamp 12 comprises a broad flat base 121 integral with one end of the connecting strip 13, a screw hole 122 at the center of the flat base 121, two curved clamping arms 123 bilaterally raised from the flat base 121 and curved toward each other, and two supporting portions 124 respectively turned outwards from the curved clamping arms 123.

The wire clamp 11 is integral with one end of the connecting strip 13 remote from the fuse clamp 12, comprising two semi-circular clamping walls 111, the clamping walls 111 each having a fixed bottom side integral with each other and a free top side, a first locating flange 112 and a second locating flange 113 respectively integral with the free top sides of the clamping walls 111, the second locating flange 113 being inserted through a hole 1113 on the opposite semi-circular clamping wall 111 and disposed in parallel to the first locating flange 112, a screw hole 1121 at the first locating flange 112, a locating hole 1131 at the second locating flange 113, and a screw 2 threaded into the screw hole 1121 and stopped against the second locating flange 113. The screw 2 has a reduced tip 21 inserted into the locating hole 1131 at the second locating flange 113. When the conductors 61 of an electric wire 6 are inserted into the axial receiving hole 1112 defined within the semi-circular clamping walls 111, the screw 2 is rotated forwards to move the locating flanges 112,113 apart, causing the diameter of the axial receiving hole 1112 to be relatively reduced, and therefore the semi-circular clamping walls 111 are firmly clamped on the conductors 61. On the contrary, when the screw 2 is rotated outwards, the material spring power of the semi-circular clamping walls 111 forces the locating flanges 11 to move toward each other, causing the diameter of the axial receiving hole 112 to be relatively increased, and therefore the conductors 61 are released from the constraint of the semi-circular clamping walls 111. Further, two stop strips 114 are respectively raised from the semi-circular clamping walls 111 and bent inwards into the axial receiving hole 1112 for stopping against the ends of the conductors 61 of the electric wire 6 to limit the insertion depth of the conductors 61 of the electric wire 6 in the axial receiving hole 1112. An opening 1111 is provided at one semi-circular clamping wall 111 for receiving the conductors 61 of the electric wire 6 peripherally when the conductors 61 of the electric wire 6 are compressed by the semi-circular clamping walls 111 and forced to curve outwards.

Figure 3:
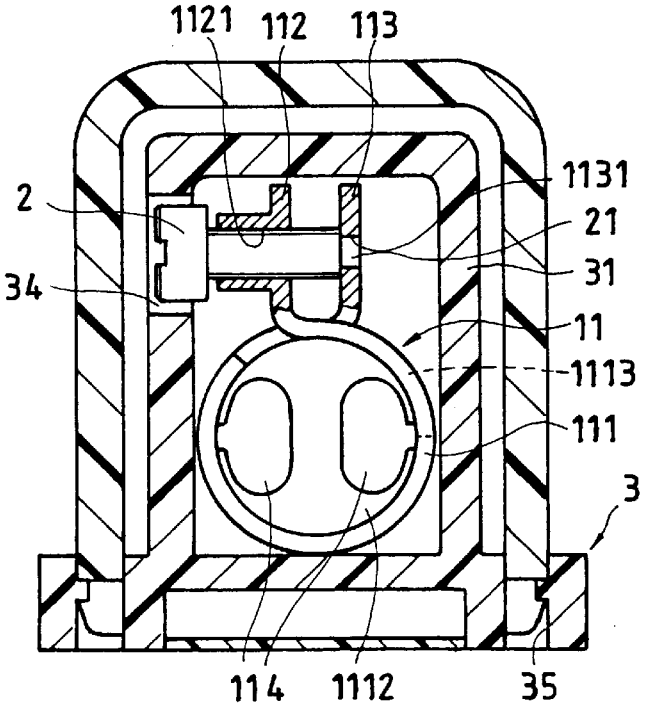
FIG. 3 is a cross sectional view of the assembly shown in FIG. 1.
Figure 2:
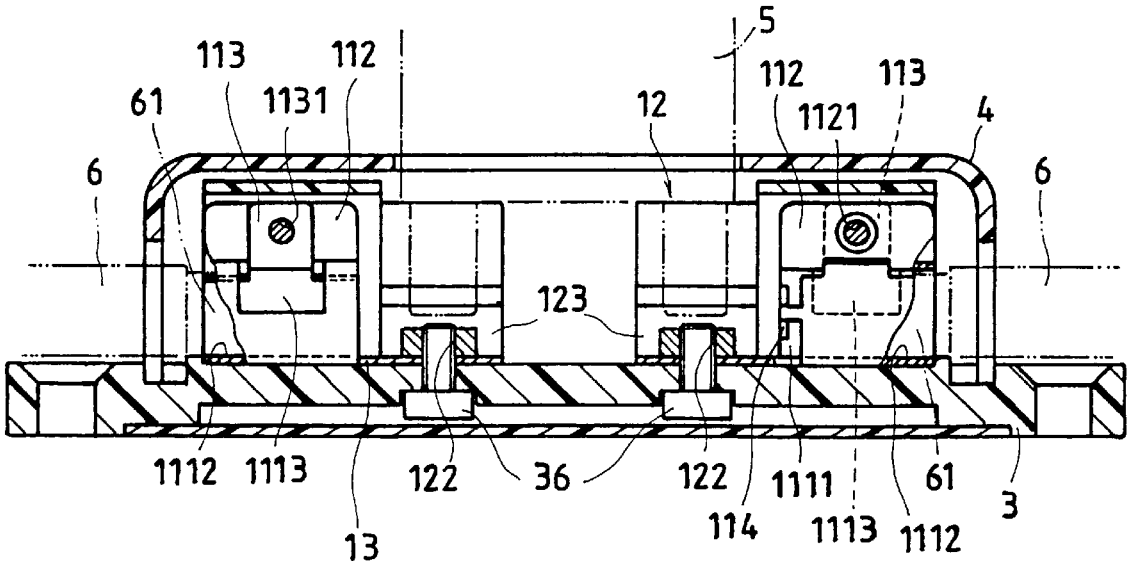
FIG. 2 is a longitudinal view in section of the assembly shown in FIG. 1.
Figure 4:
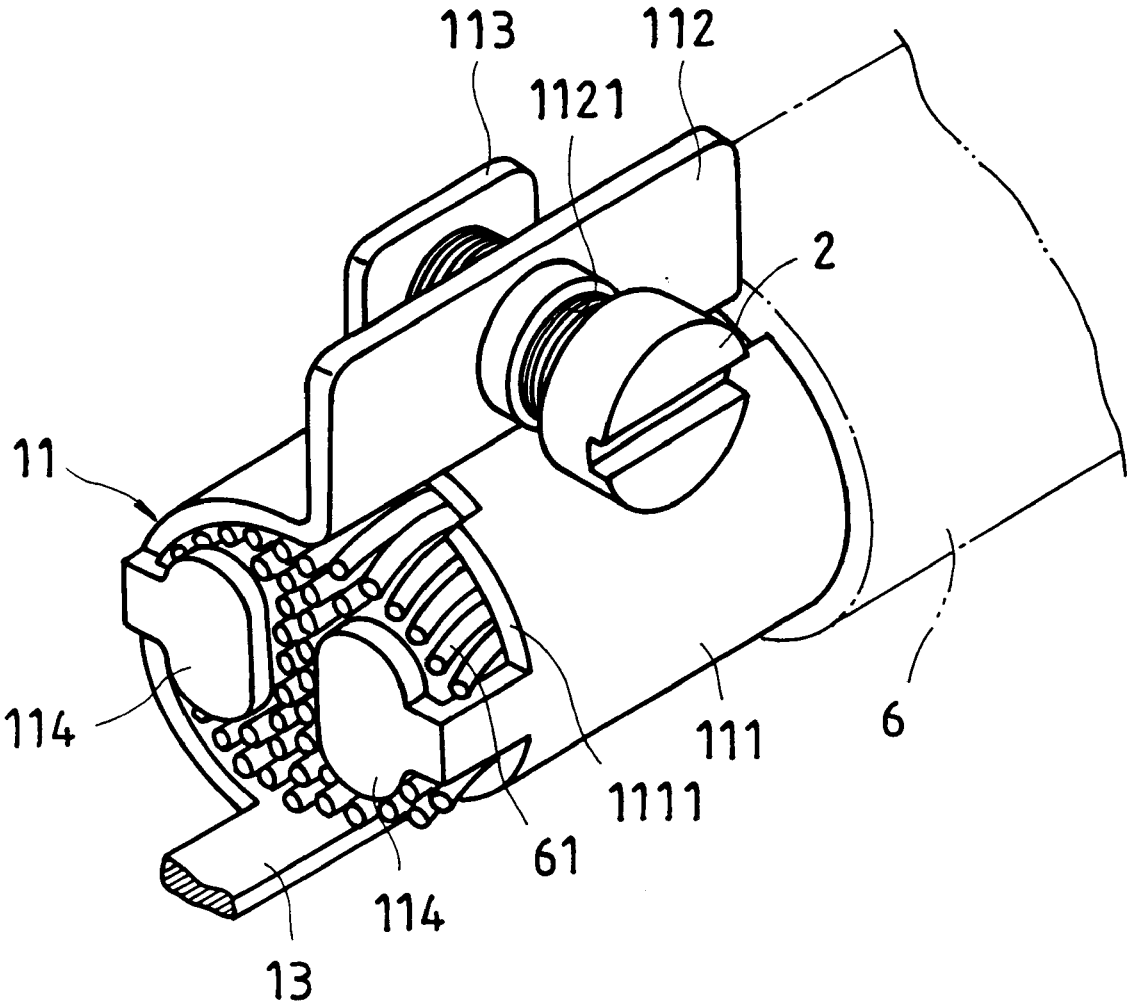
FIG. 4 is a perspective view of a part of one fuse holder according to the present invention, showing the conductors of the electric wire fastened to the wire clamp.

Referring to FIGS. 1, 2 and 3 again, two fuse holders 1 are mounted in a fuse box 3,4 to hold a fuse 5 therebetween. The fuse box 3,4 comprises a bottom shell 3, a top cover shell 4 covered on the bottom shell 3. The top cover shell 4 has downwardly extended peripheral hooks 41 respectively hooked in respective retaining holes 35 at the bottom shell 3. The bottom shell 3 comprises two shields 31 which receive the fuse holders 1 respectively, two bottom through holes 33 respectively disposed inside the shields 31, two screws 36 respectively inserted into the bottom through holes 33 from the bottom side and threaded into the screw holes 122 at the flat bases 121 of the fuse clamps 12 of the fuse holders 1 to secure the fuse holders 1 inside the shields 31, and two pairs of locating plates 32 respectively extended from the shields 31 at two opposite sides for supporting the supporting portions 124 of the fuse clamps 12 of the fuse holders 1. The shields 31 each have a tool hole 34 through which a screwdriver can be inserted to turn the screw 2 at the respective fuse holder 1.

Figure 5:
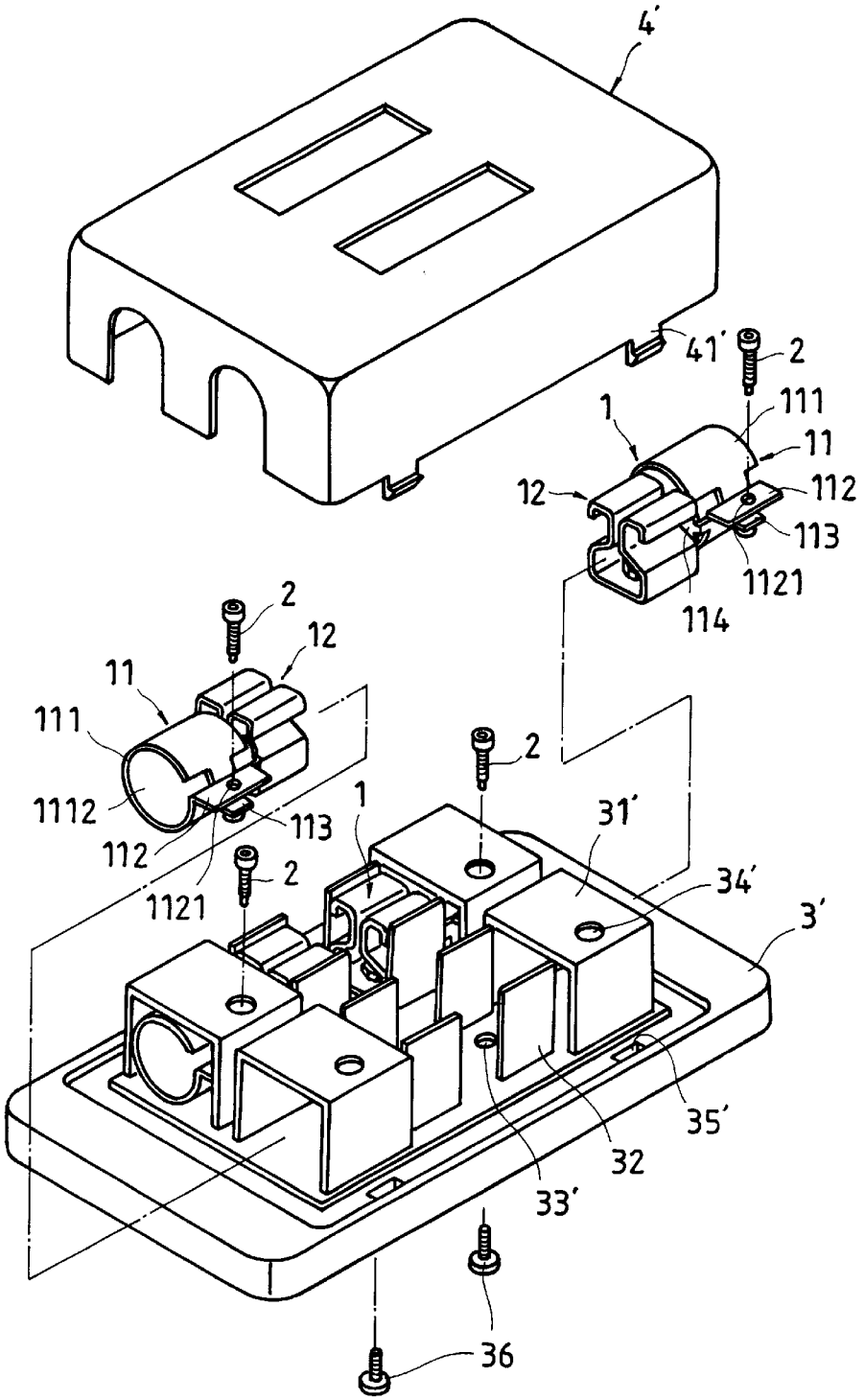
FIG. 5 is an exploded view of a second embodiment of the present invention.

Referring to FIG. 5, pairs of fuse holders 1 are mounted in pairs of shields 31' on a bottom shell 3', and fixed to respective bottom through holes 33' at the bottom shell 3' by respective screws 36, and a top cover shell 4' is covered on the bottom shell 3'. The top cover shell 4' has a plurality of downwardly extended hooks 41' respectively hooked in respective retaining holes 35' on the bottom shell 3'. The shields 31' each have a tool hole 34 through which a screwdriver can be inserted to turn the screw 2 at the respective fuse holder 1.

Figure 6:
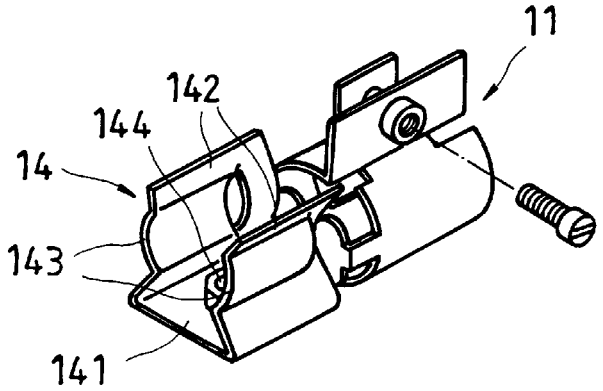
FIG. 6 is a perspective view of an alternate form of the fuse holder according to the present invention.

FIG. 6 shows an alternate form of the fuse holder. According to this alternate form, the fuse holder is comprised of a wire clamp 11 at one end, and a fuse clamp 14 at an opposite end. The structure of the wire clamp 11 is same as that shown in FIG. 1. The fuse clamp 14 comprises a flat base 141, a screw hole 144 at the center of the flat base 141 for installation, and two clamping arms 143 with a respective retaining portion 142 respectively raised from the flat base 141 at two opposite sides. This design is practical for holding a cartridge fuse.

Figure 7:
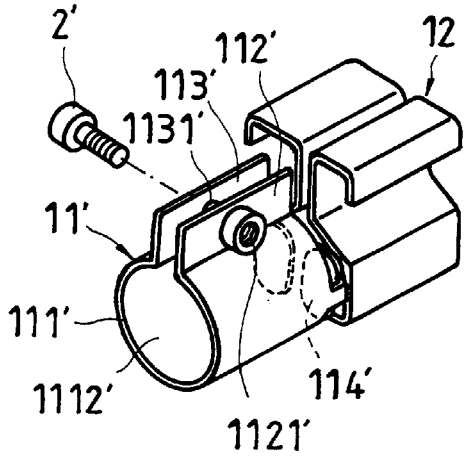
FIG. 7 is a perspective view of another alternate form of the fuse holder according to the present invention.

FIG. 7 shows another alternate form of the fuse holder. According to this alternate form, the fuse holder comprises a fuse clamp 12 at one end, and a wire clamp 11' at an opposite end. The structure of the fuse clamp 12 is same as that shown in FIG. 1. The wire clamp 11' comprises two semi-circular clamping walls 111', the clamping walls 111' each having a fixed bottom side integral with each other and a free top side, a first locating flange 112' and a second locating flange 113' respectively integral with the free top sides of the clamping walls 111', a screw hole 1121' at the first locating flange 112', a through hole 1131' at the second locating flange 113', and a screw 2' inserted through the through hole 1131' and threaded into the screw hole 1121' to secure the locating flanges 112',113' together. When the screw 2' is fastened tight, the diameter of the axial receiving hole 1112' defined within the clamping walls 111' is relatively reduced. On the contrary, when the screw 2' is loosened, the diameter of the axial receiving hole 1112' is relatively increased. Furthermore, two stop strips 114' are respectively raised from the semi-circular clamping walls 111' and bent inwards into the axial receiving hole 1112' for stopping against the ends of the conductors of the inserted electric wire in place.

Figure 8:
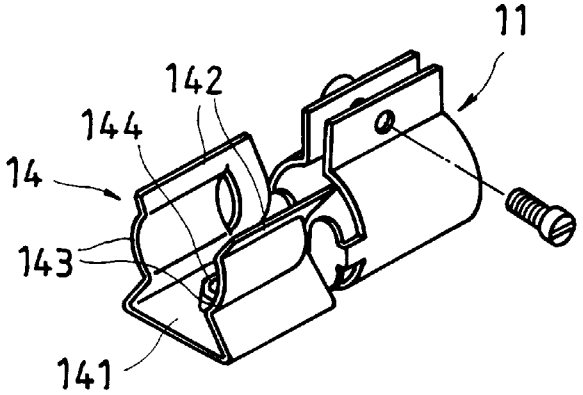
FIG. 8 is a perspective view of still another alternate form of the fuse holder according to the present invention.
Figure 9:
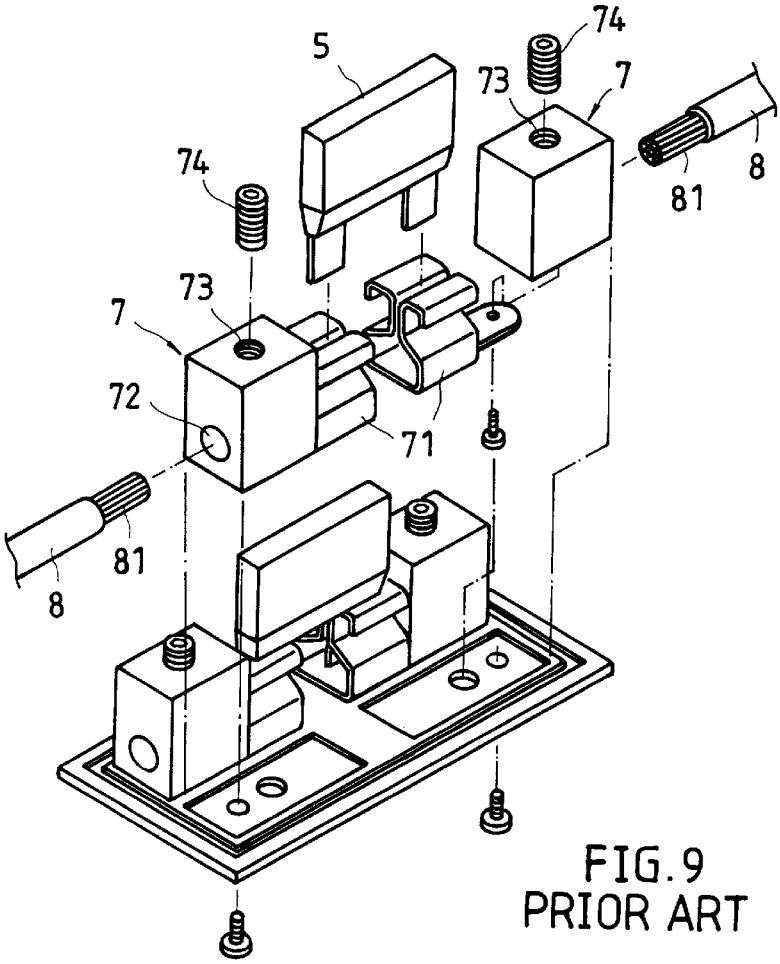
FIG.9 PRIOR ART
FIG. 9 is an exploded view of a fuse mounting arrangement according to the prior art.
Figure 10:
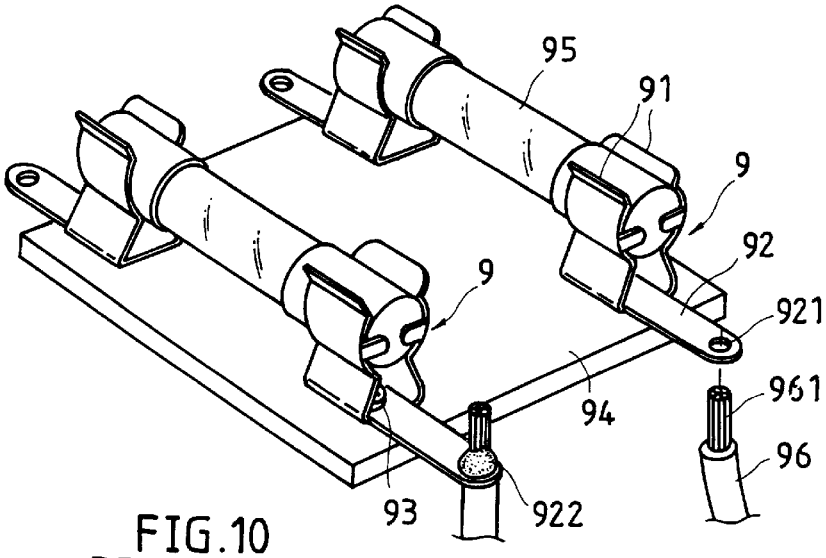
FIG.10 PRIOR ART
FIG. 10 shows another fuse mounting arrangement according to the prior art.

FIG. 8 shows still another alternate form of the fuse holder. According to this alternate form, the fuse holder comprises a wire clamp 11' at one end, and a fuse clamp 14 at an opposite end. The structure of the wire clamp 11' is same as that shown in FIG. 7. The structure of the fuse clamp 14 is same as that shown in FIG. 6.

It is to be understood that the drawings are designed for purposes of illustration only, and are not intended as a definition of the limits and scope of the invention disclosed.

What the invention claimed is:

1. A fuse box and fuse holder assembly comprising a fuse box, at least one pair of fuse holders mounted inside said fuse box or holding fuse means, said fuse box comprising a bottom shell and a top cover shell mounted on said bottom shell, said bottom shell comprising at least one pair of upstanding shields which receive therein said at least one pair of fuse holders respectively, a plurality of bottom through holes respectively disposed inside said shields, a plurality of screws respectively mounted in said bottom through holes to secure said fuse holders inside said shields, pairs of locating plates respectively extending from said shields at two opposite sides for supporting said fuse holders in place, and a plurality of retaining holes symmetrically disposed at two opposite sides of said bottom shell, said top cover shell comprising a plurality of downwardly extended hooks respectively hooked in the retaining holes at said bottom shell, said shields each having a tool hole corresponding to a wire clamp of the respective fuse holder, said fuse holders each comprising a fuse clamp at one end for holding a part of a fuse means, a wire clamp at an opposite end for holding conductors of an electric wire, and a connecting strip connected between said fuse clamp and said wire clamp.

2. The fuse box and fuse holder assembly of claim 1 wherein the fuse clamp of each of said fuse holders comprises a broad flat base, a screw hole provided at the center of said flat base and fastened to the screw hole at one bottom through hole of said bottom shell, two curved clamping arms bilaterally raised from said flat base and curved toward each other, and two supporting portions respectively turned outwards from said curved clamping arms and supported on the corresponding locating plates at said bottom shell; the wire clamp of each of said fuse holders comprises a first semi-circular clamping wall and a second semi-circular clamping wall, said semi-circular clamping walls each having a fixed bottom side integral with each other and a free top side, a first locating flange and a second locating flange respectively integral with the free top sides of said semi-circular clamping walls, said second locating flange being inserted through a hole on said first semi-circular clamping wall and disposed in parallel to said first locating flange, a screw hole at said first locating flange, a locating hole at said second locating flange, and an adjustment screw threaded into the screw hole at said first locating flange and stopped against said second locating flange, said adjustment screw having a reduced tip inserted into the locating hole at said second locating flange.

3. The fuse box and fuse holder arrangement of claim 1 wherein the wire clamp of each of said fuse holders comprises a first semi-circular clamping wall and a second semi-circular clamping wall, said semi-circular clamping walls each having a fixed bottom side integral with each other and a free top side, a first locating flange and a second locating flange respectively integral with the free top sides of said semi-circular clamping walls, said second locating flange being inserted through a hole on said first semi-circular clamping wall and disposed in parallel to said first locating flange, a screw hole at said first locating flange, a locating hole at said second locating flange, and an adjustment screw threaded into the screw hole at said first locating flange and stopped against said second locating flange, said adjustment screw having a reduced tip inserted into the locating hole at said second locating flange; the fuse clamp of each of said fuse holders comprises a flat base, a screw hole provided at the center of said flat base and fastened to the screw hole at one bottom through hole of said bottom shell, and two clamping arms respectively raised from said flat base at two opposite sides, said clamping arms each having a retaining portion for securing the corresponding fuse means in place.

4. The fuse box and fuse holder arrangement of claim 1 wherein the fuse clamp of each of said fuse holders comprises a road flat base, a screw hole provided at the center of said flat base and fastened to the screw hole at one bottom through hole of said bottom shell, two curved clamping arms bilaterally raised from said flat base and curved toward each other, and two supporting portions respectively turned outwards from said curved clamping arms and supported on the corresponding locating plates at said bottom shell; the wire clamp of each of said fuse holders comprises two semi-circular clamping walls, said semi-circular clamping walls each having a fixed bottom side integral with each other and a free top side, a first locating flange and a second locating flange respectively integral with the free top sides of said semi-circular clamping walls, a screw hole at said first locating flange, a through hole at said second locating flange, and a screw inserted through the through hole at said second locating flange and threaded into the screw hole at said first locating flange to secure said first and second locating flanges together.

5. The fuse box and fuse holder arrangement of claim 1 wherein the fuse clamp of each of said fuse holders comprises a flat base, a screw hole provided at the center of said flat base and fastened to the screw hole at one bottom through hole of said bottom shell, and two clamping arms respectively raised from said flat base at two opposite sides, said clamping arms each having a retaining portion for securing the corresponding fuse means in place; the wire clamp of each of said fuse holders comprises two semi-circular clamping walls, said semi-circular clamping walls each having a fixed bottom side integral with each other and a free top side, a first locating flange and a second locating flange respectively integral with the free top sides of said semi-circular clamping walls, a screw hole at said first locating flange, a through hole at said second locating flange, and a screw inserted through the through hole at said second locating flange and threaded into the screw hole at said first locating flange to secure said first and second locating flanges together.

* * * * *